US007331334B2

(12) United States Patent
Leone et al.

(10) Patent No.: US 7,331,334 B2
(45) Date of Patent: Feb. 19, 2008

(54) SYSTEM AND METHOD FOR PURGING FUEL VAPORS USING EXHAUST GAS

(75) Inventors: Thomas Leone, Ypsilanti, MI (US); Ralph Wayne Cunningham, Milan, MI (US)

(73) Assignee: Ford Global Technologies LLC, Dearborn, MI (US)

( * ) Notice: Subject to any disclaimer, the term of this patent is extended or adjusted under 35 U.S.C. 154(b) by 82 days.

(21) Appl. No.: 11/355,395

(22) Filed: Feb. 15, 2006

(65) Prior Publication Data

US 2007/0186910 A1 Aug. 16, 2007

(51) Int. Cl.
*F02M 37/20* (2006.01)
*F01N 3/00* (2006.01)

(52) U.S. Cl. ..... 123/516; 60/274

(58) Field of Classification Search ..... 123/568.11, 123/568.15, 568.21, 568.22, 698, 699, 516, 123/518, 519–520
See application file for complete search history.

(56) References Cited

U.S. PATENT DOCUMENTS 5,021,071 A * 6/1991 Reddy ..... 95/106
5,207,734 A * 5/1993 Day et al. ..... 60/278
5,239,824 A * 8/1993 Matsumoto ..... 60/283
5,272,873 A * 12/1993 Hamazaki ..... 60/283
5,273,020 A * 12/1993 Hayami ..... 123/520
5,388,558 A * 2/1995 Plapp et al. ..... 123/520
5,619,973 A * 4/1997 Hara et al. ..... 123/520
5,806,304 A * 9/1998 Price et al. ..... 60/274
5,946,906 A 9/1999 Akazaki et al.
6,102,003 A * 8/2000 Hyodo et al. ..... 123/436
6,122,908 A * 9/2000 Wirmark ..... 60/274
6,247,457 B1 * 6/2001 Mallebrein ..... 123/520
6,463,907 B1 10/2002 Hiltner
2005/0155587 A1 * 7/2005 Suzuki ..... 123/520

* cited by examiner

*Primary Examiner*—Thomas Moulis
(74) *Attorney, Agent, or Firm*—Allan J. Lippa; Alleman Hall McCoy Russell & Tuttle LLP

(57) ABSTRACT

A system for a vehicle, comprising of an engine, and a fuel vapor storage system coupled to the engine configured to store and release fuel vapors, the system further configured to route exhaust gas from the engine to the vapor storage system and where adsorbed vapors are released into the exhaust gas before the exhaust gas is re-inducted into the engine to be burned.

20 Claims, 5 Drawing Sheets

SYSTEM AND METHOD FOR PURGING FUEL VAPORS USING EXHAUST GAS

BACKGROUND AND SUMMARY

Vehicles having internal combustion engines typically utilize intake manifold vacuum for power accessories and facilitating certain emission control activities. In particular, engines utilize intake manifold vacuum to draw stored fuel vapors from a carbon canister or other vapor storage device. In this way, fuel vapors generated in the fuel tank can be contained and then used in the engine to reduce emission of such vapors.

Various types of engine operation can affect the level of vacuum in the intake manifold, such as variation in the engine load, engine air-fuel ratio, engine valve timing and/or lift, cylinder deactivation, and engine combustion mode (such as homogenous charge compression ignition operation, HCCI), for example. Under some conditions, such engine operation can reduce available vacuum below that needed to purge sufficient fuel vapors. Thus, some approaches adjust engine operation (e.g., by adjusting air-fuel ratio, valve timing, throttling, etc.) to manage the intake manifold vacuum, while others may utilize a vacuum pump to generate additional vacuum when needed.

However, the inventors herein have recognized several issues with such approaches. While adjusting engine operation may be appropriate under some conditions, it may also result in lost fuel savings due to an inability to operating in a more efficient combustion mode. For example, due to a need to purge fuel vapors, the engine may operate in more efficient combustion modes, such as HCCI, less often than otherwise possible. Also, throttling to generate vacuum may increase engine pumping work. Further, utilizing external vacuum pumps or other such devices can also increase parasitic losses and thus degrade fuel economy, in addition to increasing cost.

The inventors herein have further recognized that it may be beneficial to push the vapors from the canister into the intake manifold using exhaust pressure, rather than, or in addition to, pulling the vapors using manifold vacuum. In this way, it may be possible to enable additional operation at lower vacuum levels, thus extending more fuel efficient combustion modes, for example.

Further, increased temperature from the exhaust gas may enable more efficient purging under some conditions. Specifically, the higher temperature of the exhaust gas (compared with fresh air) may help purge fuel vapors from a vapor storage device, such as a charcoal canister since vapor purging is an endothermic reaction. In other words, the charcoal canister normally cools when fresh air is used for purging. Using at least some exhaust gas for purging would raise the temperature and thus enable purging with a smaller volume of gas, further reducing the need for intake manifold vacuum.

Note that there are various sources of exhaust gas that may be used to purge fuel vapors, such as exhaust gas recirculation gas, or other exhaust gas.

DETAILED DESCRIPTION

Figure 1:
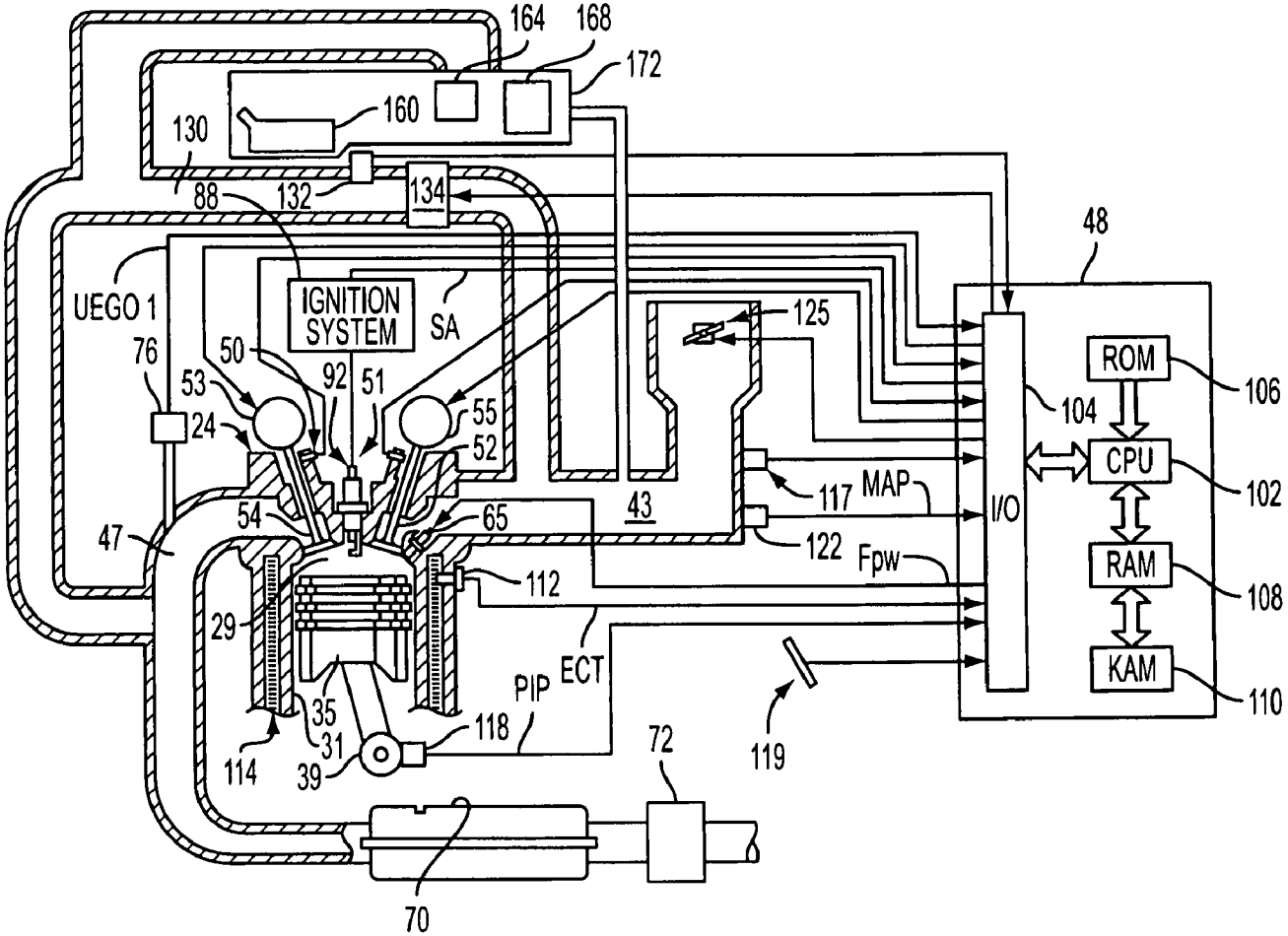
FIG. 1 is a schematic diagram of an engine.

FIG. 1 shows an example engine 24 as a direct injection gasoline engine with a spark plug; however, engine 24 may be a port injection gasoline engine, or a diesel engine without a spark plug, or another type of engine. Internal combustion engine 24 may include a plurality of cylinders, one cylinder of which is shown in FIG. 1, which is controlled by electronic engine controller 48. Engine 24 includes combustion chamber 29 and cylinder walls 31 with piston 35 positioned therein and connected to crankshaft 39. Combustion chamber 29 is shown communicating with intake manifold 43 and exhaust manifold 47 via respective intake valve 52 and exhaust valve 54. While only one intake and one exhaust valve are shown, the engine may be configured with a plurality of intake and/or exhaust valves.

Engine 24 is further shown configured with an exhaust gas recirculation (EGR) system configured to supply exhaust gas to intake manifold 43 from exhaust manifold 47 via EGR passage 130. The amount of exhaust gas supplied by the EGR system can be controlled by EGR valve 134. Further, the exhaust gas within EGR passage 130 may be monitored by an EGR sensor 132, which can be configured to measure temperature, pressure, gas concentration, etc. Under some conditions, the EGR system may be used to regulate the temperature of the air and fuel mixture within the combustion chamber, thus providing a method of controlling the timing of autoignition for HCCI combustion.

In some embodiments, as shown in FIG. 1, variable valve timing may be provided by variable cam timing (VCT); however other methods may be used such as electrically controlled valves. While in this example, independent intake cam timing and exhaust cam timing are shown, variable intake cam timing may be used with fixed exhaust cam timing, or vice versa. Also, various types of variable valve timing may be used, such as the hydraulic vane-type actuators 53 and 55 receiving respective cam timing control signals VCTE and VCTI from controller 48. Cam timing (exhaust and intake) position feedback can be provided via comparison of the crank signal PIP and signals from respective cam sensors 50 and 51.

In some embodiments, cam actuated exhaust valves may be used with electrically actuated intake valves, if desired. In such a case, the controller can determine whether the engine is being stopped or pre-positioned to a condition with the exhaust valve at least partially open, and if so, hold the intake valve(s) closed during at least a portion of the engine stopped duration to reduce communication between the intake and exhaust manifolds. In addition, intake manifold 43 is shown communicating with optional electronic throttle 125.

Engine 24 is also shown having fuel injector 65 coupled thereto for delivering liquid fuel in proportion to the pulse width of signal FPW from controller 48 directly to combustion chamber 29. As shown, the engine may be configured such that the fuel is injected directly into the engine cylinder, which is known to those skilled in the art as direct injection. Distributorless ignition system 88 provides ignition spark to combustion chamber 29 via spark plug 92 in response to controller 48. Universal Exhaust Gas Oxygen (UEGO) sensor 76 is shown coupled to exhaust manifold 47 upstream of catalytic converter 70. Exhaust gas sensor 76 is shown coupled to exhaust manifold 48 upstream of catalytic converter 70. The signal from sensor 76 can be used to advantage during feedback air/fuel control in a conventional manner to maintain average air/fuel at stoichiometry during the stoichiometric homogeneous mode of operation.

Controller 48 is shown in FIG. 1 as a conventional microcomputer including: microprocessor unit 102, input/output ports 104, and read-only memory 106, random access memory 108, keep alive memory 110, and a conventional data bus. Controller 48 is shown receiving various signals from sensors coupled to engine 24, in addition to those signals previously discussed, including: engine coolant temperature (ECT) from temperature sensor 112 coupled to cooling sleeve 114; a pedal position sensor 119 coupled to an accelerator pedal; a measurement of engine manifold pressure (MAP) from pressure sensor 122 coupled to intake manifold 43; a measurement (ACT) of engine air charge temperature or manifold temperature from temperature sensor 117; and an engine position sensor from a Hall effect sensor 118 sensing crankshaft 39 position. In some embodiments, the requested wheel output can be determined by pedal position, vehicle speed, and/or engine operating conditions, etc. In one aspect of the present description, engine position sensor 118 produces a predetermined number of equally spaced pulses every revolution of the crankshaft from which engine speed (RPM) can be determined.

FIG. 1 shows engine 24 configured with an aftertreatment system comprising a catalytic converter 70 and a lean NOx trap 72. In this particular example, the temperatures of catalytic converter 70 and/or NOx trap 72 may be measured by temperature sensors in the devices or in the exhaust manifold, or may be estimated based on operating conditions. Further, exhaust gas oxygen sensors may be arranged in exhaust passage 47 upstream and/or downstream of lean NOx trap 72. Lean NOx trap 72 may include a three-way catalyst that is configured to adsorb NOx when engine 24 is operating lean of stoichiometry. The adsorbed NOx can be subsequently reacted with HC and CO and catalyzed when controller 48 causes engine 24 to operate in either a rich homogeneous mode or a near stoichiometric homogeneous mode such operation occurs during a NOx purge cycle when it is desired to purge stored NOx from the lean NOx trap, or during a vapor purge cycle to recover fuel vapors from fuel tank 160 and fuel vapor storage canister 164 via purge control valve 168, or during operating modes requiring more engine power, or during operation modes regulating temperature of the emission control devices such as catalyst 70 or lean NOx trap 72. It will be understood that various different types and configurations of emission control devices and purging systems may be employed.

As will be described in more detail herein, combustion in engine 24 can be of various types, depending on a variety of conditions. In one example, spark ignition (SI) may be used where the engine utilizes a sparking device to perform a spark so that a mixture of air and fuel combusts. In another example, homogeneous charge compression ignition (HCCI) may be used where a substantially homogeneous air and fuel mixture attains an autoignition temperature within the combustion chamber and combusts without requiring a spark from a sparking device. However, other types of combustion are possible. For example, the engine may operate in a spark assist mode, wherein a spark is used to initiate autoignition of an air and fuel mixture. In yet another example, the engine may operate in a compression ignition mode that is not necessarily homogeneous. It should be appreciated that the examples disclosed herein are non-limiting examples of the many possible combustion modes.

During SI mode, the temperature of intake air entering the combustion chamber may be near ambient air temperature and is therefore substantially lower than the temperature required for autoignition of the air and fuel mixture. Since a spark is used to initiate combustion in SI mode, control of intake air temperature may be more flexible as compared to HCCI mode. Thus, SI mode may be utilized across a broad range of operating conditions (such as higher or lower engine loads), however SI mode may produce different levels of emissions and fuel efficiency under some conditions compared to HCCI combustion.

In some conditions, during SI mode operation, engine knock may occur if the temperature within the combustion chamber is too high. Thus, under these conditions, engine operating conditions may be adjusted so that engine knock is reduced, such as by retarding ignition timing, reducing intake charge temperature, varying combustion air-fuel ratio, or combinations thereof.

During HCCI mode operation, the air/fuel mixture may be highly diluted by air and/or residuals (e.g. lean of stoichiometry), which results in lower combustion gas temperature. Thus, engine emissions may be substantially lower than SI combustion under some conditions. Further, fuel efficiency with autoignition of lean (or diluted) air/fuel mixture may be increased by reducing the engine pumping loss, increasing gas specific heat ratio, and by utilizing a higher compression ratio. During HCCI combustion, autoignition of the combustion chamber gas may be controlled so as to occur at a prescribed time so that a desired engine torque is produced. Since the temperature of the intake air entering the combustion chamber may be critical to achieving the desired autoignition timing, operating in HCCI mode at high and/or low engine loads may be difficult.

Controller 48 can be configured to transition the engine between a spark ignition (SI) mode and a homogeneous charge compression ignition (HCCI) mode based on operating conditions of the engine and/or related systems, herein described as engine operating conditions.

As described above with reference to FIG. 1, engine 24 may include a fuel vapor purge system comprising fuel tank 160, fuel vapor storage device 164 (which may be a charcoal canister), and purge control valve 168 fluidly coupled to intake manifold 43. Further, as shown in FIG. 1, exhaust gas may be routed to the purge system via system 172. While FIG. 1 shows one example of utilizing exhaust gas in a fuel vapor purge system, various alternative examples are described herein with regard to FIGS. 2-4.

Returning to FIG. 1, some of the engine exhaust gas is routed through the charcoal canister and then back into the engine intake manifold. As described herein, such an approach may be used to enable purging of fuel vapors without regard to intake manifold vacuum levels. Further, it may enable more efficient purging with a lower volume of gas flow due to increased exhaust gas temperature compared with fresh air. Such an approach may be particularly suitable for HCCI operation, which may run extremely lean and/or with high amounts of EGR. Specifically, since HCCI engines may operate with larger amounts of EGR, it may be possible to enable larger amounts of exhaust to be used for purging the stored fuel vapors. Further, since HCCI exhaust temperature may be lower than exhaust temperature during spark ignition operation (SI) or other engine modes, this may lower the potential of excessive heat causing degradation to the charcoal canister. Note, however, that the use of exhaust gas, such as exhaust gas recirculation (EGR) gas, to aid purging is not limited to HCCI engine operation. For example, it may be used in with cylinder deactivation, camless valvetrains, engine boosting (supercharging and/or turbocharging), various forms of variable valve timing, and/or lean burn.

For systems in which only exhaust gas, such as EGR, is used for purging fuel vapors without fresh air, at least during some conditions, EGR tolerance and temperature limits of the storage device, e.g., charcoal canister, may be considered, alone or in combination. For example, if the charcoal canister can tolerate higher temperatures, then smaller amounts of hotter EGR can be used to purge the canister. Alternatively, if the EGR temperature is too high, the EGR may be cooled, so larger amounts of EGR can be used to purge the canister, and thus the engine's tolerance for EGR (combustion stability) may be considered.

Alternatively, if both fresh air and exhaust gas are used to purge fuel vapors, temperature of the canister may be regulated by adjusting the relative and/or absolute amounts of the fresh or exhaust gas, or combinations thereof. For example, depending on engine conditions (e.g. in HCCI or SI mode, higher vs lower load, etc.), different amounts of fresh air and/or exhaust gas may be used to purge fuel vapors.

Still another advantage of utilizing exhaust gas for purging fuel vapors is that it may be possible to purge vapors even during un-throttled (or lightly throttled) conditions. For example, a one-way valve, such as a reed valve, can utilize exhaust pressure pulsations to drive the flow, even if negative oscillations would otherwise reverse the flow directions.

In some embodiments, the internal combustion engine can be configured to operate in a plurality of purge states. For example, fuel vapors may be purged into all or a subset of engine cylinders operating in a particular combustion mode. Alternatively, the engine may be operated with different cylinders in different combustion modes, where fuel vapors are fed to all or a subset of cylinders or cylinder groups. Still other examples may be used, as described herein.

Figure 2:
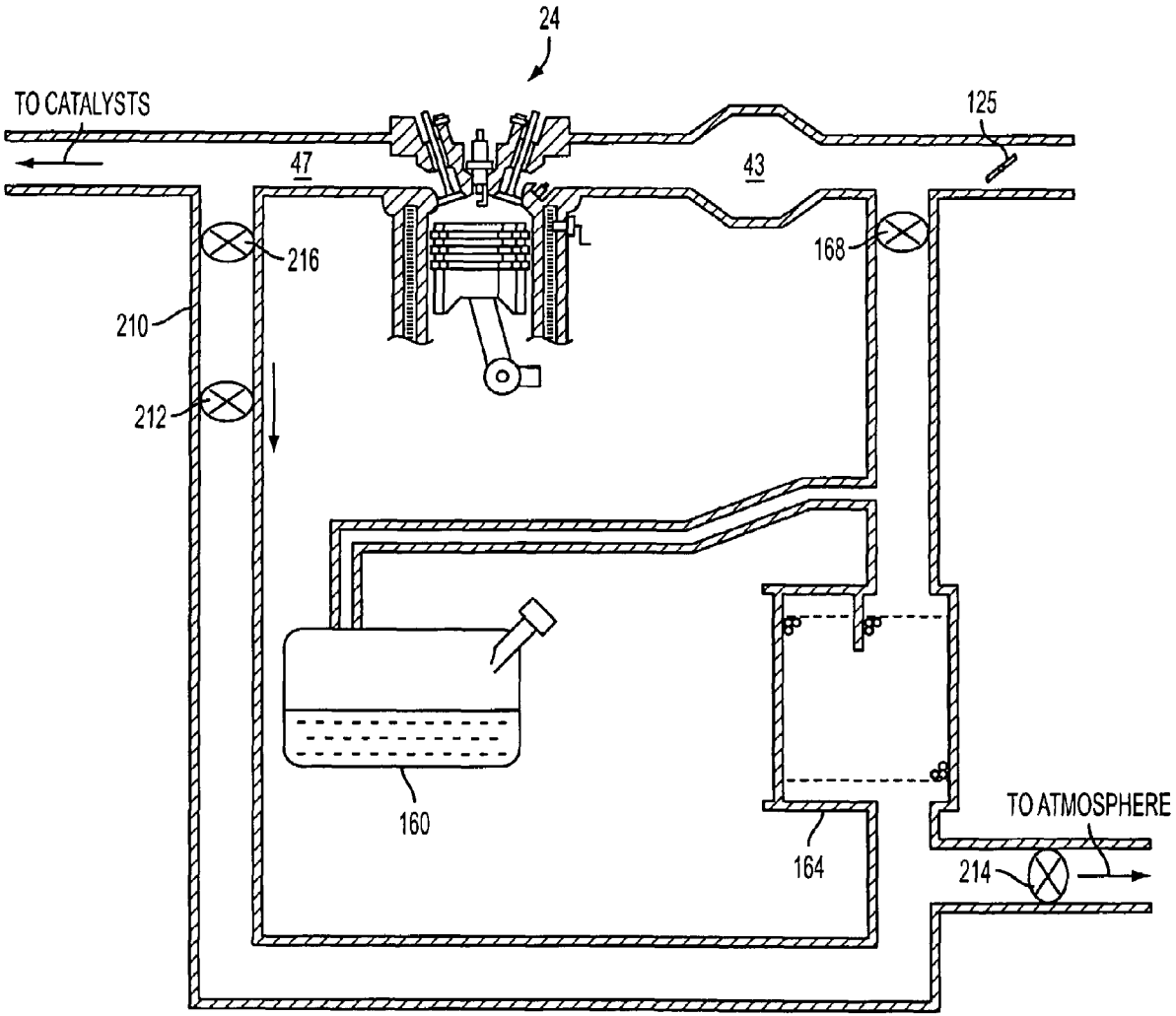
FIGS. 2-4 are various alternative examples of a system configuration for utilizing exhaust gas to purge fuel vapors.

Referring now to FIG. 2, an alternative embodiment is shown in which a fuel vapor storage and purging system is shown utilizing fresh air and exhaust gas. In this example, valves 168 and 216 are closed and valve 214 is open when the engine is off, to allow fuel vapors from the fuel tank to be captured by charcoal canister 164, without building up excessive pressure in the tank. When the engine is running and purge of the charcoal canister is desired, valves 168 and 216 can be opened and valve 214 can be closed to route exhaust gas through passage 210 to canister 164, and purge fuel vapors from canister 164 into intake manifold 43. A one-way valve 212 is shown between the exhaust passage and fuel canister 164 for enabling exhaust gas to flow toward the canister (and to the intake manifold 43). Valve 212 may be any type of one-way valve, but in one example may be a reed-type valve to enable pressure buildup in the presence of pulsating intake and exhaust manifold pressures. Control valves 214 and 216 may be used to adjust the relative amount of fresh air and exhaust fed through the fuel vapor storage system, where valves 214 and 216 receive control signals from a controller, such as controller 48 (see FIG. 1). Control valve 168 may also be used to control when fuel vapors are fed to intake manifold 43.

In the example of FIG. 2, it may be possible to utilize a varying amount of exhaust gas and/or fresh air for purging fuel vapors to the engine, depending on operating conditions of the engine via respective control of valves 216 and 214.

Figure 3:
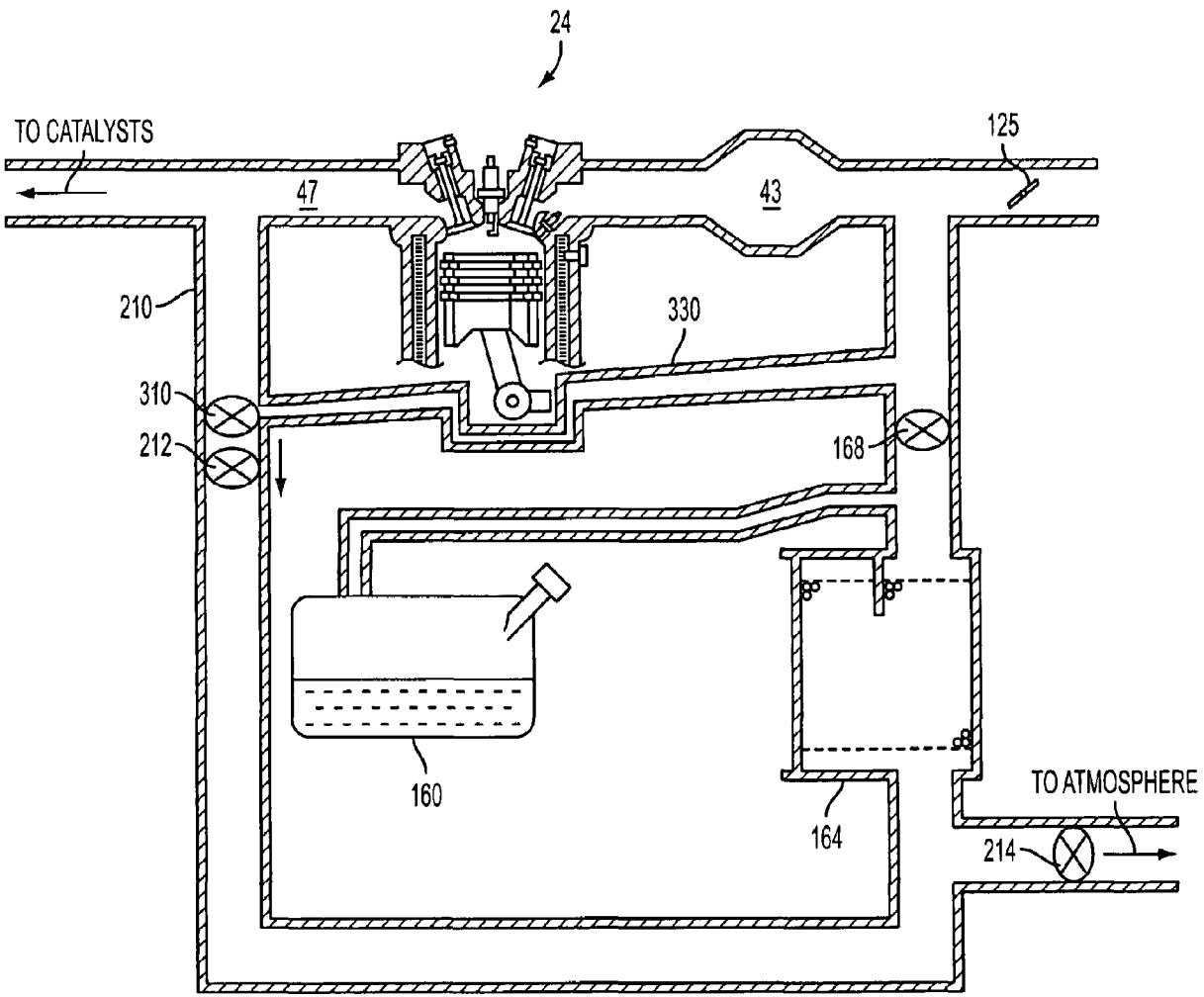

Referring now to FIG. 3, still another alterative embodiment is shown in which a bypass passage 330 is shown for routing exhaust gas to the intake manifold without passing through canister 164. A three way valve 310 may be used to route exhaust gas to one-way valve 212 or to passage 330, or combinations thereof. In this way, it may be possible to enable addition exhaust gas recirculation (EGR) flexibility independent of fuel vapor purging operation. For example, EGR may be performed without fuel vapor purging, and vice versa via appropriate control of valve 310.

Figure 4:
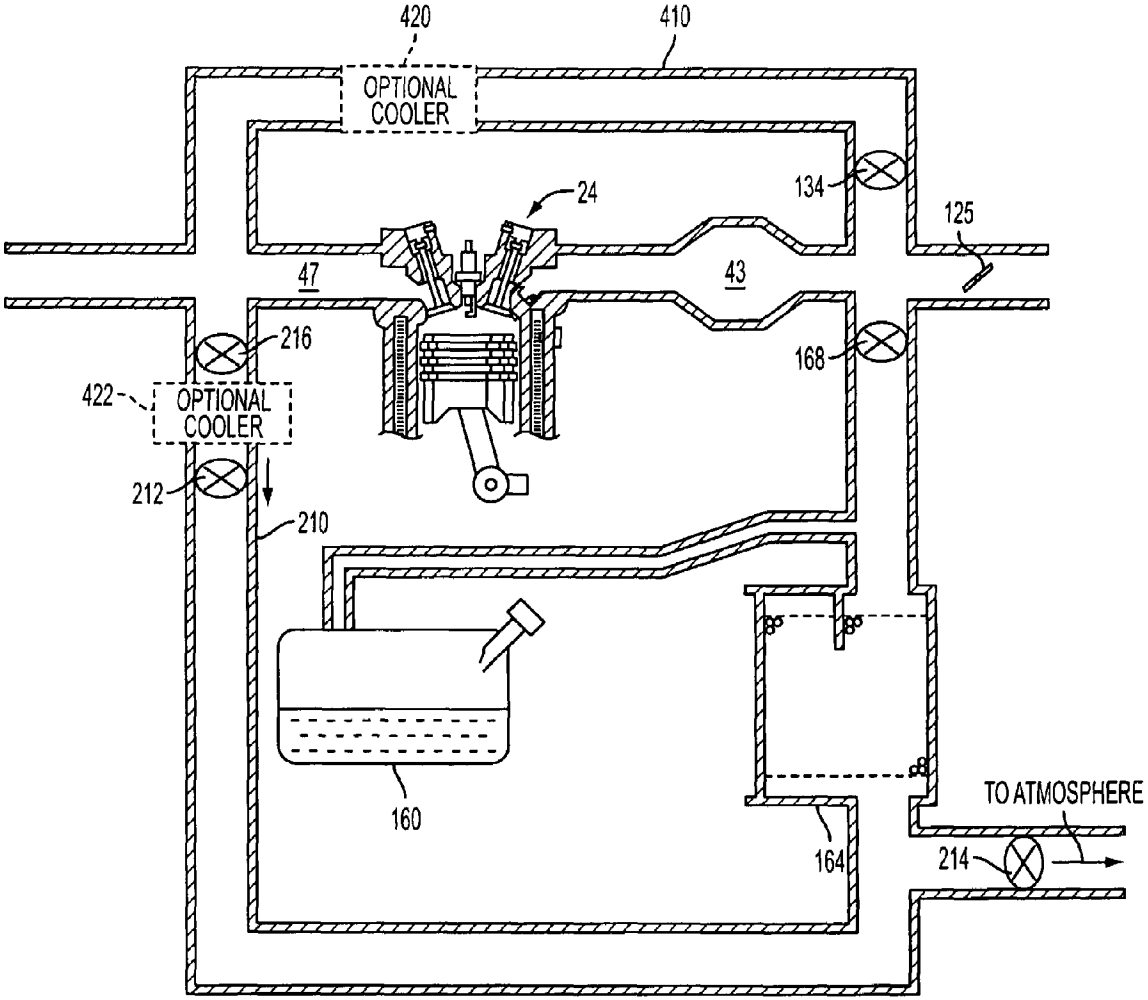

Referring now to FIG. 4, yet another alterative embodiment is shown in which an EGR passage 410 is shown separate from purging passage 210. Further, optionally coolers (420 and 422) may be placed in one or both of passages 210 and 410 to cool the exhaust gas. It is understood that the location or sequence of components may be varied, for example the locations of coolers 420 and 422 relative to valves 134, 212, and 216 may be different than that shown in FIG. 4. Also, one or more coolers may be used in the embodiments described in FIGS. 2 and 3.

Figure 5:
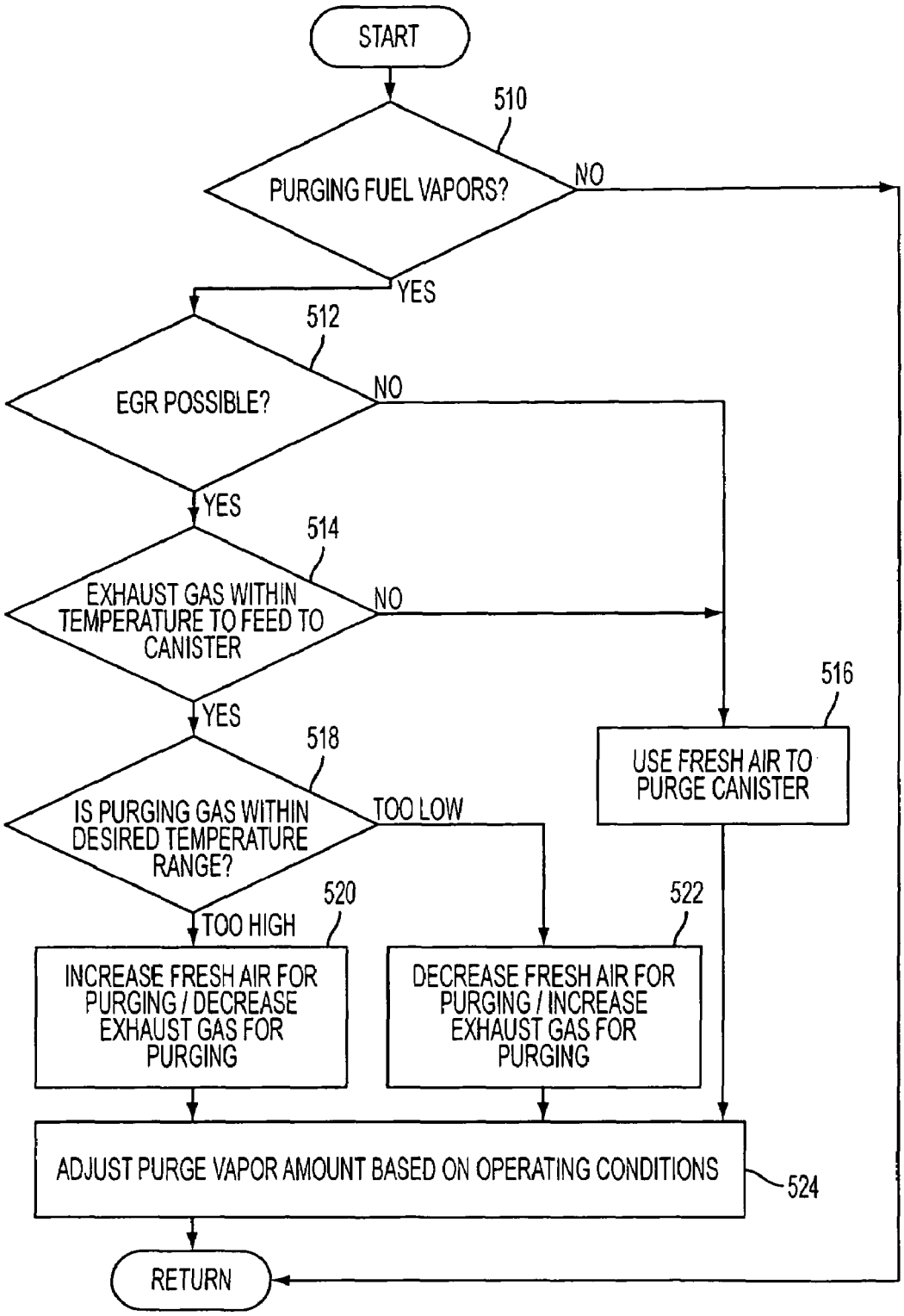
FIG. 5 is a flowchart of an example method to control system operation.

FIG. 5 shows an example routine describing control of a vehicle engine and fuel vapor purging system. Note that the example control and estimation routines included herein can be used with various engine system configurations and that the specific routines described herein may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated steps or functions may be repeatedly performed depending on the particular strategy being used. Further, the described steps may graphically represent code to be programmed into the computer readable storage medium in controller 48 as described above, during fuel vapor purging operation.

Referring now to FIG. 5, an example routine is described for controlling system operation. Specifically, in 510, the routine determines whether the engine should purge fuel vapors from a fuel vapor storage system. If so, the routine continues to 512 to determine whether the engine can tolerate exhaust gas recirculation (EGR). This determination may include consideration of whether a lean exhaust gas is present, such as based on exhaust gas sensor 76, or based on input from other sensors. For example, the engine may be more likely to tolerate EGR when running significantly lean, because the exhaust gas contains more oxygen. For example, the lean exhaust gas may be generated by lean homogeneous or lean stratified combustion in the cylinders, or by a mixture of fuel cut-out operation in some cylinders and combustion in other cylinders. Also, rather than identifying the exhaust air-fuel ratio, the routine may also identify whether the engine is in a lean combustion mode, such as HCCI operation, for example.

If the answer to 512 is yes, the routine continues to 514 to determine whether the exhaust gas is within a temperature threshold to feed to a fuel vapor storage canister, such as canister 164. The temperature may be read from a sensor or estimated, as noted above herein. For example, if the exhaust gas temperature is too high (e.g., above a threshold), the routine may proceed to 516 in which only fresh air is used to purge fuel vapors, rather than using exhaust gas. Likewise, if the answer to 512 is no, the routine may also proceed to 516.

Otherwise, when the answer to 514 is yes, the routine proceeds to 518 to determine whether the measured or inferred purging gas is within a desired temperature range. For example, in the example where a mixture of fresh air and exhaust gas is fed to a fuel vapor storage and purging system, the routine may identify whether the mixture fed to the system is within a desired temperature range for improved purging, where the desired range may vary with operating conditions such as the level of canister loading, fuel tank pressure, canister temperature, and/or others. Alternatively, the routine may monitor the measured or inferred canister temperature and determine whether it is within threshold range.

The desired temperature range may be based on various other factors, such as exhaust air-fuel ratio, fuel tank temperature, combustion mode, canister fill level, fuel tank level, and/or combinations thereof.

If the temperature is too high, the routing may proceed to 520 to increase the fresh air amount for purging and/or decrease the exhaust gas amount for purging fuel vapors. Alternatively, if the temperature is too low, the routing may proceed to 522 to decrease the fresh air amount for purging and/or increase the exhaust gas amount for purging fuel vapors. In either 520 and/or 522, for example, the routine may adjust a vent valve and/or EGR valve such as valves 214 and 216 to vary the mixture, and thus the temperature, of gas fed to the canister. Alternatively, the routine may adjust a single valve that adjusts the amount of exhaust gas fed to a canister, such as valve 310 in FIG. 3. In addition, the routine may also adjust the amount of purge gas fed to the intake manifold based on operating conditions via valve 168, for example, in 524.

In this way, it is possible to advantageously utilize exhaust gas, such as exhaust gas recirculation, to improve purging performance and reduce reliance on intake manifold vacuum. Further, it is possible to take advantage of lean exhaust gas (which typically results in reduced intake manifold vacuum) by utilizing the excess oxygen and increased temperature to improve purging of fuel vapors from a fuel vapor storage system such as a charcoal canister.

Note that in the example where exhaust gas is used to carry fuel purge vapor to the engine, fuel injection, sparking timing, etc. may be adjusted based on a level of fuel vapor in the gas, as well as the exhaust air-fuel ratio.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-8, V-10, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A system for a vehicle, comprising:

an engine; and a fuel vapor storage system coupled to the engine configured to store and release fuel vapors, the system further configured to mute exhaust gas from the engine to the storage system and where adsorbed vapors are released into the exhaust gas before the exhaust gas is re-inducted into the engine to be burned.

2. The system of claim 1 wherein fuel vapor storage system is further configured to teed said exhaust gas having released vapors to an intake manifold of the engine at a pressure higher than manifold pressure.

3. The system of claim 2 wherein fuel vapor storage system is further configured to receive said exhaust gas from an exhaust manifold of the engine.

4. The system of claim 3 further comprising a controller configured to operate the engine in lean combustion mode.

5. The system of claim 4 further comprising a controller configured to operate the engine in a homogenous charge compression ignition mode.

6. The system of claim 3 wherein said exhaust gas fed to said fuel vapor storage system has excess oxygen.

7. The system of claim 1 further comprising a controller configured to vary an amount of exhaust gas fed to the fuel vapor storage system based on operating conditions.

8. The system of claim 7 wherein said operating condition is at least one of a combustion mode of the engine, exhaust temperature, and exhaust air-fuel ratio.

9. The system of claim 7 wherein said operating conditions include temperature of the fuel vapor storage system being below a threshold temperature, where the controller increases exhaust gas fed to the fuel vapor storage system.

10. The system of claim 1 wherein the fuel vapor storage system includes a carbon canister.

11. A system for a vehicle, comprising:

an engine having an intake manifold and an exhaust manifold;

a fuel vapor storage system coupled to the engine configured to store and release fuel vapors;

an exhaust side passage to route exhaust gas from said exhaust manifold to said fuel vapor storage system;

an intake side passage to route gas from said fuel vapor storage system to said intake manifold;

a valve coupled in the system, said valve configured to adjust an amount of gas flowing through the fuel vapor storage system; and a controller configured to adjust said valve as an operating condition of the system varies, said controller adjusting said valve white routing exhaust gas from the exhaust manifold via said exhaust side passage, through the fuel vapor storage system to the intake side passage, and into the intake manifold.

12. The system of claim 11 further comprising a one-way valve coupled in the system, the valve configured to allow exhaust gas to flow from said exhaust gas manifold to said fuel vapor storage system.

13. The system of claim 11 further comprising a second exhaust side passage to route exhaust gas from said exhaust manifold to a second intake side passage.

14. The system of claim 11 wherein said valve is coupled in said intake side passage.

15. A method for operating an engine of a vehicle, the vehicle having a fuel tank and a fuel vapor storage system coupled to the engine, the method comprising:

adjusting an amount of exhaust gas fed to the fuel vapor storage system;

releasing vapors stored in the fuel vapor storage system into said fed exhaust gas; and routing said exhaust gas from the fuel vapor storage system to an intake manifold of the engine so that the exhaust gas is re-inducted into the engine to be burned carrying released fuel vapors.

16. The method of claim 15 where said amount of gas is adjusted based on an exhaust air-fuel ratio of the engine.

17. The method of claim 15 wherein said amount of gas is adjusted based on a combustion mode of the engine.

18. The method of claim 15 wherein the exhaust gas includes exhaust gas generated by homogeneous charge compression ignition, the method further comprising adjusting said amount based on temperature.

19. The method of claim 15 further comprising feeding a varying amount of fresh air to the fuel vapor storage system.

20. The method of claim 19 further comprising adjusting both said amount of exhaust gas and said amount of fresh air based on operating conditions to adjust a temperature of gas fed to the fuel vapor storage system.

* * * * *

UNITED STATES PATENT AND TRADEMARK OFFICE

CERTIFICATE OF CORRECTION

PATENT NO. : 7,331,334 B2
APPLICATION NO. : 11/355395
DATED : February 19, 2008
INVENTOR(S) : Thomas Leone and Ralph Wayne Cunningham It is certified that error appears in the above-identified patent and that said Letters Patent is hereby corrected as shown below:

Please amend to read as follows:

Column 7, Claim 1, Line 66: Delete “mute” and insert –route-- therefor.

Column 8, Claim 2, Line 4: Delete “teed” and insert --feed-- therefor.

Signed and Sealed this

Twenty-fourth Day of March, 2009

John Doll

JOHN DOLL
*Acting Director of the United States Patent and Trademark Office*